US005633222A

United States Patent [19]

Sköld et al.

[11] Patent Number: 5,633,222

[45] Date of Patent: May 27, 1997

[54] USE OF A SECONDARY AMINE AS A CORROSION INHIBITING AND ANTIMICROBIAL AGENT AND AN AQUEOUS ALKALINE INDUSTRIAL FLUID CONTAINING SAID AMINE

[75] Inventors: Rolf Sköld, Stenungsund, Sweden; Patrick J. Ruane, Newbury, Great Britain

[73] Assignees: Berol Nobel AB, Stenungsund, Sweden; Castrol Limited, Wiltshire, Great Britain

[21] Appl. No.: 454,277

[22] PCT Filed: Dec. 8, 1993

[86] PCT No.: PCT/SE93/01060

§ 371 Date: Jul. 25, 1995

§ 102(e) Date: Jul. 25, 1995

[87] PCT Pub. No.: WO94/13765

PCT Pub. Date: Jun. 23, 1994

[30] Foreign Application Priority Data

Dec. 17, 1992 [SE] Sweden ..... 9203798

[51] Int. Cl.[6] ..... C10M 173/02; C10M 133/08

[52] U.S. Cl. ..... 508/562; 508/561

[58] Field of Search ..... 252/49.3; 508/562

[56] References Cited

U.S. PATENT DOCUMENTS

| | | | |
|---|---|---|---|
| 3,280,029 | 10/1966 | Waldmann | 508/562 |
| 3,502,581 | 3/1970 | Cyba | 508/297 |
| 3,630,898 | 12/1971 | Teeter et al. | 252/49.3 |
| 3,897,349 | 7/1975 | Marin et al. | 252/33.3 |
| 4,533,481 | 8/1985 | Jahnke | 252/49.6 |
| 4,670,172 | 6/1987 | Sproul et al. | 252/49.3 |
| 4,749,503 | 6/1988 | Bennett et al. | 508/487 |
| 4,762,628 | 8/1988 | Phillips et al. | 508/562 |
| 4,925,582 | 5/1990 | Bennett | 252/49.3 |
| 4,929,375 | 5/1990 | Rossio et al. | 252/49.3 |
| 4,943,381 | 7/1990 | Phillips et al. | 508/562 |
| 4,976,919 | 12/1990 | Sköld et al. | 252/49.3 |
| 5,132,046 | 7/1992 | Edebo et al. | 252/49.3 |
| 5,254,277 | 10/1993 | Gentit et al. | 508/562 |
| 5,399,274 | 3/1995 | Marcus | 252/49.3 |
| 5,441,654 | 8/1995 | Rossio | 252/49.3 |

FOREIGN PATENT DOCUMENTS

| | | |
|---|---|---|
| 0180561 | 5/1986 | European Pat. Off. . |
| 0192358 | 8/1986 | European Pat. Off. . |
| 0196810 | 10/1986 | European Pat. Off. . |
| 89/09254 | 10/1989 | WIPO . |

*Primary Examiner*—Ellen M. McAvoy

[57] ABSTRACT

Secondary amines having the formula (I): $R(Y)_sNHX$, in which R is a hydrocarbon group having 2–12 carbon atoms, Y is the group —$CH(OH)CH_2$—, —$OCH_2CH(OH)CH_2$— or —$O(CH_2)_3$, X is an alkyl group having 2–3 carbon atoms and substituted with hydroxyl groups in the 2-position or in the 2 - and 3-positions, and s is 0 or 1 with the condition that when s is 0, then X is an alkyl group substituted in the 2- and 3-positions, or a salt thereof, are used as anticorrosion and antimicrobial agents. They are suitable to be incorporated in aqueous, alkaline, industrial fluids. An aqueous, alkaline metal working fluid is also disclosed.

13 Claims, No Drawings

USE OF A SECONDARY AMINE AS A CORROSION INHIBITING AND ANTIMICROBIAL AGENT AND AN AQUEOUS ALKALINE INDUSTRIAL FLUID CONTAINING SAID AMINE

BACKGROUND OF THE INVENTION

1. Field of the Invention

The present invention relates to the use of a secondary amine as a corrosion inhibiting and antimicrobial agent especially cially in an aqueous alkaline industrial fluid, such as an aqueous metal working fluid. The effects of the secondary amine are especially favourable at a pH value above 8.

2. Description of the Related Art

Water-based alkaline industrial fluids, such as metal working fluids, hydraulic fluids, coolants and cleaning fluids, undergo after some time of use or storage undesirable changes which can be related to the fact that the components included in the fluids are degraded by bacteria, fungi and other micro-organisms. The microbial degradation considerably reduces the life and the performance of the fluids. For example the microbial degradation of the fluids may destroy the corrosion inhibiting and lubricating properties. From an economic point of view, it is therefore of great importance that microbial degradation of fluids of this type be minimised.

Well-known antimicrobial agents used in metal working fluids are formaldehyde or compounds giving off formaldehyde. Since formaldehyde readily evaporates from the fluid in open systems, the formaldehyde content will be successively reduced and the surrounding air contaminated with formaldehyde at the same time.

Other antimicrobial agents are quaternary ammonium compounds, but their use, e.g. in metal working fluids, has involved many practical problems, for instance because of reaction with organic acids and anionic surfactants that may be present in the formulation.

The use, as antimicrobial agents, of reaction products of boric acid and a number of organic compounds, such as alkanolamines and carboxylic acids is also known in cutting fluids. However, such reaction products have been found to have a relatively low antimicrobial effect, primarily on fungi, and must therefore be used in relatively large amounts.

From articles by E. O. Bennett, e.g. his article in J. A. Soc. Lubr. Eng., 35 (1979), 137–144, U.S. Pat. No. 4,749,503, and European Patent Application 412 089, it is known that secondary and tertiary alkanolamine compounds substituted by hydrocarbon groups having 1–18 carbon atoms have an antimicrobial effect in cutting fluids and coolants.

The use of a number of alkoxylated amines and alkanolamines in order to obtain a tool life extension is known from European Patent Applications Nos. 196,810 and 192,358. For metal working fluids containing N-methylethanolamine a lowered susceptibility to the growth of mold and bacteria is reported. From the European Patent 180,561 it is also known that certain tertiary alkanolamines have corrosion inhibiting effects in metal working fluids.

Alkanolamines, such as monoethanolamine, diethanolamine, diisopropanolamine and triethanolamine, have frequently been used as corrosion inhibiting agents in aqueous alkaline industrial fluids. From U.S. Pat. Nos. 3,280,029 and 4,976,919 and European Publication No 180,561, it is well-known to use secondary and tertiary alkyl alkanolamines as corrosion inhibiting agents.

SUMMARY OF THE INVENTION

According to the present invention it has now been found that secondary amines having the formula $$R(Y)_sNHX \quad (I)$$

in which R is an hydrocarbon group having 2–12 carbon atoms, Y is the group —CH(OH)$CH_2$—, —$CH_2$CH(OH)$CH_2$—, or —O$(CH_2)_3$—, X is an alkyl group having 2–3 carbon atoms and substituted with hydroxyl groups in the 2-position or in the 2- and 3-positions, and s is 0 or 1 with the condition that when s is 0, then X is an alkyl group substituted in the 2- and 3-positions, or a salt thereof, have good corrosion inhibiting effects as well as excellent antimicrobial effects and can be used in the preparation of aqueous alkaline industrial fluids, such as metal working fluids, hydraulic fluids, coolants, heat transfer media and cleaning fluids. These industrial fluids contain organic compounds for achieving specific technical effects. As the industrial fluids are often stored and/or used for a long time they are frequently subject to attacks by microorganisms whereby the amount of the organic compounds are reduced as well as the desired effects e.g. anticorrosion effects obtained by their presence. It is a well-known fact that especially aqueous metal working fluids are strongly exposed to bacteria and fungi. However, the secondary amines of formula I have proved to be very effective as anticorrosion and antimicrobial agents under the conditions present in aqueous synthetic and semi-synthetic metal working fluids. The fact that the secondary amines have antimicrobial efficacy also directly supports the maintenance of corrosion inhibiting properties of the same amines. The aqueous alkaline fluid of the invention may be in the form of an emulsion, microemulsion, colloidal solution or a true solution.

DESCRIPTION OF THE PREFERRED EMBODIMENTS

Preferred embodiments of the secondary amines of formula I are those encompassed by the formulae $$RCH(OH)CH_2NHC_2H_4OH \quad (II)$$

$$RO(CH_2)_3NHC_2H_4OH \quad (III)$$

$$ROCH_2CH(OH)CH_2NHC_2H_4OH \quad (IV)$$

and $$RNHCH_2CH(OH)CH_2OH \quad (V)$$

in which R has the meaning stated above, or a salt thereof.

Especially compounds having the R-groups not directly linked to the nitrogen atom, i.e. the compounds with formulae II, III and IV, or a salt thereof, have a good iron corrosion inhibiting effect.

The secondary amine compound of the formula I exhibit ex- cellent antimicrobial effects in synthetic formulations while in semisynthetic formulations those compounds having formula III usually are preferred. The amounts to be used of the secondary amines may vary within wide limits due to the speci- fic application area but it is normally from 0.001–10% by weight, preferably from 0.01–2% by weight.

The secondary amines of the formula I may easily be prepared by conventional methods. For example secondary amine compounds of formula II and IV may be prepared by reacting an olefin epoxide, preferably a linear alpha-olefin or the corresponding chloroglyceryl ether with an excess of monoethanolamine at a temperature of 80°–120° C. and 60°–80° C. respectively. Secondary amines of formula III may be prepared by reacting an alcohol with acrylonitrile in the presence of alkali such as NaOH or KOH, or the corresponding alcolates. The obtained nitrile compound is hydrogenated into a primary amine in the presence of a conventional hydrogenation catalyst and then ethoxylated to a secondary amine of formula III. If desired the secondary amine containing reaction mixture is purified by fractional distillation. By reacting 2,3-epoxy-1-propanol with an excess of a primary amine, secondary amines of formula V are obtained in high yields with respect to the epoxy compound. If desired, the secondary amine may be used in form of a salt soluble in water and/or oil. Especially preferred are salts with pharmaceutically acceptable anions. Specific examples of salts are phosphates, sulphates, phosphonates, sulphonates and carboxylates. The acyclic hydrocarbon group R in the secondary amine of formula (I) may be straight or branched, saturated or unsaturated. Preferably it is a straight hydrocarbon group with 4–10 carbon atoms. Most preferably R is a $C_{6-8}$-alkyl group. Examples of suitable groups are butyl, hexyl, octyl and decyl.

The metal working fluid according to the invention has preferably a pH value of at least 8, most preferably between 8 and 10, and contains a secondary amine having the formula I or a salt thereof in an amount of 0.001 to 10% by weight, preferably 0.01 to 2% by weight.

In addition to the secondary amine the metal working fluid may contain lubricants and other corrosion inhibitors.

The corrosion inhibitors are normally present in an amount of 0.1–10%, preferably 0.2–3%, by weight of the metal working fluid. Examples of suitable corrosion inhibitors are besides the secondary amines of formula I, other amine compounds, such as mono-, di- or triethanolamine, alkali metal hydroxides, triazole or thiadiazole compounds, monocarboxylic acids having 6–11 carbon atoms and dicarboxylic acids, preferably having 6–12 carbon atoms, such as azelaic acid or sebacic acid, alkyl- or aryl-sulphonamidocarboxylic acids; inorganic acids, such as boric acid, and conventional reaction products between boric acid and/or carboxylic acids with organic compounds, such as alkanolamines. Examples of corrosion inhibitors are also the amine compounds described in European Publication No. 180,561.

In order to increase the friction-reducing capacity, the metal working fluids may also contain lubricants. They are usually selected from the group consisting of esters or amides of mono- or dicarboxylic acids having at least 10 carbon atoms in the acyl groups; monocarboxylic acids having 12 or more carbon atoms; dicarboxylic acid having more than 12 carbon atoms; organic phosphate esters containing one or two hydrocarbon carbon groups having 6–18 carbon atoms; nonionic alkylene oxide adducts having a molecular weight above 400, such as polypropylene glycol or randomly distributed polypropylene ethylene glycols or block polymers of ethylene and propylene oxide and mixtures thereof; and oils. The amount of the lubricant is 0.05–10%, preferably 0.1–2%, by weight of the metal working fluid. Preferably the monocarboxylic acid lubricants are coconut fatty acids, oleic acid, groundnut acids and rapeseed acids and esters and amides of these acids with polyols, such as glycerol, trimethylolpropane, pentaerythritol and polyalkylene glycols, and alkanolamines respectively. The hydrocarbon groups of the organic phosphate esters can be octyl, nonyl, decyl,dodecyl,tetradecyl and hexadecyl as well as their corresponding unsaturated alkenyl groups. Anionic lubricants also have a corrosion-preventing capacity against iron.

The metal working compounds containing an oil as a lubricant have often the form of an emulsion or a colloidal solution. With the term "oil" is here understood a class of substances of synthetic, mineral, vegetable or animal origin. Usually, they are from petroleum or are petroleum-derived but synthetic hydrocarbons such as poly-alpha-olefins (PAO's) or alkylates, such as alkyl benzenes, are also used. These compositions also include emulsifying agents which are usually nonionic and/or anionic surfactants. Examples of anionic surfactants are alkylaryl sulphonates, such as dodecylbenzene sulphonates, alkylsulphates; such as sulphates of alcohols or alkoxylated alcohols; sulphated esters, such as sulphated castor oil; and phosphates of alcohols or ethoxylated alcohols. Examples of nonionic surfactants are alkoxylated alkyl phenols, alcohols, carboxylic acids, alkanolamines, alkylamines and alkylamides. The alkoxylation agent is normally an alkylene oxide containing 2–4 carbon atoms. Preferably at least 50% of the alkyleneoxy groups are ethyleneoxy groups and they may be either arranged in blocks or distributed at random. In a preferred embodiment the polyoxyalkylene is end-capped with propyleneoxy and/or butyleneoxy units in order to obtain a low-foaming surfactant. The anionic and nonionic surfactants are normally so chosen that they contain 8–20 carbon atoms in a hydrocarbon residue. By the amount of ethyleneoxy units in the surfactant the HLB-balance can be further regulated.

In addition to corrosion inhibitors and lubricants, the metal working fluid may advantageously also contain pH-adjusting agents, metal complex stabilizers, defoamers, perfumes, viscosity-adjusting and solubility-improving agents in known manner. Suitable solubility-improving agents are glycols, such as hexylene glycol; alcohols, such as tridecanol and oleylalcohol; and glycol ethers, such as butyldioxitol and butyltrioxitol.

Aqueous heat transfer media are for instance used in cooling towers, municipal hot water distribution systems and building heating systems, while coolants are used in metal working and quenching processes. Heat transfer media and coolants of the invention usually contains, in addition to the secondary amine of formula I or a salt thereof, corrosion inhibitors, metal complexing agents, anti-scaling agents, dispersing agents and/or pH-regulating agents. The hydraulic fluids may also contain lubricants and viscosity regulating agents.

The cleaning fluids contain beside the secondary amine with the formula I or a salt thereof, a surfactant with micelle forming power. The surfactant is anionic, cationic, amphoteric or nonionic. Normally an anionic surfactant or a combination of a nonionic surfactant and an anionic surfactant is preferred. The cleaning fluids also comprise conventional additives, such as inorganic builders, defoamers, foam boosters, metal complexing agents, solubilizers and corrosion inhibitors.

The present invention is further illustrated by the following Examples.

EXAMPLE 1

A semi-synthetic metal working fluid concentrate having an concentration of 5% by weight was prepared from the following components.

| Components | % by weight |
|---|---|
| Refined paraffinic oil | 40.8–48.3 |
| Sodium petroleum sulphonate (Mwt 440) | 14.0 |
| Oleic acid | 10.0 |
| Chlorinated paraffin (65% chlorine) | 8.0 |
| 50% aqueous potassium hydroxide | 3.2 |
| Water | 2.0 |
| Neopentyl glycol dioleate | 5.0 |
| Hexylene glycol | 4.0–10.0 |
| Tridecanol, branched | 0.5–2.0 |
| Amine in accordance with tables 1–4 | 5.0 |

In order to obtain homogeneous compositions hexylene glycol and tridecanol may be incorporated in larger amounts than the minimum amount in the table above. The increased amounts added are balanced by corresponding reductions in the amount of the refined paraffinic oil.

Anticorrosion performance was established using a modified version of The Institute of Petroleum IP 287/82 test method. In the modified procedure deionised water was used instead of a synthetic water of 200 ppm of calcium carbonate in the preparation of the test emulsion. Cast iron chips were placed on Whatman number 6 filter paper and wetted with the above formulation diluted with water for 2 hours at ambient temperature. The percentage area stained was recorded.

The following tables show the anticorrosion performance where emulsions were tested at pH 9.0 and 9.5. pH of the formulations was varied using acetic acid/KOH.

TABLE 1

Corrosion tests using R—CH(OH)$CH_2NHC_2H_4OH$

| | | | | Percent corrosion area for R | | | |
|---|---|---|---|---|---|---|---|
| Dilution | pH | — | DIPA[1)] | $C_4H_9$ | $C_6H_{13}$ | $C_8H_{17}$ | $C_{10}H_{21}$ |
| 10:1 | 9.0 | 1 | 0 | 0 | 0 | 0 | 0 |
| 15:1 | 9.0 | 2 | 5 | 0 | 0 | 0 | 0 |
| 20:1 | 9.0 | 4 | 15 | 0 | 0 | 0 | 0 |
| 30:1 | 9.0 | 17 | 65 | 1 | 1 | 1 | 1 |
| 40:1 | 9.0 | 27 | 70 | 37 | 6 | 4 | 1 |
| 10:1 | 9.5 | 0 | 0 | 0 | 0 | 0 | 0 |
| 15:1 | 9.5 | 1 | 1 | 0 | 0 | 0 | 0 |
| 20:1 | 9.5 | 4 | 2 | 0 | 0 | 0 | 0 |
| 30:1 | 9.5 | 10 | 28 | 1 | 1 | 0 | 0 |
| 40:1 | 9.5 | 35 | 45 | 2 | 1 | 1 | 0 |

[1)]Diisopropanolamine

TABLE 2

Corrosion tests using R—$O(CH_2)_3NHC_2H_4OH$

| | | | | Percent corrosion area for R | | | |
|---|---|---|---|---|---|---|---|
| Dilution | pH | — | DIPA[1)] | $C_4H_9$ | $C_6H_{13}$ | $C_8H_{17}$ | $C_{10}H_{21}$ |
| 10:1 | 9.0 | 1 | 0 | 0 | 0 | 0 | 0 |
| 15:1 | 9.0 | 2 | 5 | 0 | 0 | 0 | 3 |
| 20:1 | 9.0 | 4 | 15 | 0 | 0 | 0 | 3 |
| 30:1 | 9.0 | 17 | 65 | 1 | 1 | 1 | 4 |
| 40:1 | 9.0 | 27 | 70 | 19 | 1 | 1 | 7 |
| 10:1 | 9.5 | 0 | 0 | 0 | 0 | 0 | 0 |

TABLE 2-continued

Corrosion tests using R—$O(CH_2)_3NHC_2H_4OH$

| | | | | Percent corrosion area for R | | | |
|---|---|---|---|---|---|---|---|
| Dilution | pH | — | DIPA[1)] | $C_4H_9$ | $C_6H_{13}$ | $C_8H_{17}$ | $C_{10}H_{21}$ |
| 15:1 | 9.5 | 1 | 1 | 0 | 0 | 0 | 0 |
| 20:1 | 9.5 | 4 | 2 | 0 | 0 | 0 | 1 |
| 30:1 | 9.5 | 10 | 28 | 1 | 0 | 0 | 2 |
| 40:1 | 9.5 | 35 | 45 | 5 | 0 | 0 | 3 |

[1)]Diisopropanolamine

TABLE 3

Corrosion tests using R—$OCH_2CH(OH)CH_2$—NH—$CH_2CH_2OH$

| | | | | Percent corrosion area for R | | | |
|---|---|---|---|---|---|---|---|
| Dilution | pH | — | DIPA[1)] | $C_4H_9$ | $C_6H_{13}$ | $C_8H_{17}$ | $C_{10}H_{21}$ |
| 10:1 | 9.0 | 1 | 0 | 1 | 0 | 0 | 0 |
| 15:1 | 9.0 | 2 | 5 | 2 | 0 | 0 | 0 |
| 20:1 | 9.0 | 4 | 15 | 4 | 1 | 0 | 0 |
| 30:1 | 9.0 | 17 | 65 | 28 | 17 | 1 | 4 |
| 40:1 | 9.0 | 27 | 70 | 35 | 38 | 2 | 14 |
| 10:1 | 9.5 | 0 | 0 | 1 | 0 | 0 | 0 |
| 15:1 | 9.5 | 1 | 1 | 2 | 0 | 0 | 0 |
| 20:1 | 9.5 | 4 | 2 | 2 | 1 | 0 | 0 |
| 30:1 | 9.5 | 10 | 28 | 5 | 4 | 0 | 1 |
| 40:1 | 9.5 | 35 | 45 | 16 | 27 | 1 | 4 |

[1)]Diisopropanolamine

TABLE 4

Corrosion tests using R—NH—$CH_2CH(OH)CH_2OH$

| | | | | Percent corrosion area for R | | | |
|---|---|---|---|---|---|---|---|
| Dilution | pH | — | DIPA[1)] | $C_4H_9$ | $C_6H_{13}$ | $C_8H_{17}$ | $C_{10}H_{21}$ |
| 10:1 | 9.0 | 1 | 0 | 0 | 1 | 0 | 0 |
| 15:1 | 9.0 | 2 | 5 | 1 | 2 | 1 | 0 |
| 20:1 | 9.0 | 4 | 15 | 2 | 3 | 1 | 1 |
| 30:1 | 9.0 | 17 | 65 | 14 | 22 | 2 | 4 |
| 40:1 | 9.0 | 27 | 70 | 63 | 30 | 9 | 5 |
| 10:1 | 9.5 | 0 | 0 | 0 | 1 | 0 | 0 |
| 15:1 | 9.5 | 1 | 1 | 1 | 2 | 0 | 0 |
| 20:1 | 9.5 | 4 | 2 | 5 | 2 | 0 | 0 |
| 30:1 | 9.5 | 10 | 28 | 9 | 11 | 2 | 1 |
| 40:1 | 9.5 | 35 | 45 | 24 | 40 | 3 | 4 |

[1)]Diisopropanolamine

From the results it is evident that all the secondary amines of the invention have good corrosion inhibiting effects. Especially the secondary amines having formulae II, III and IV exhibit excellent anticorrosion properties.

EXAMPLE 2

Semi-synthetic and synthetic metalworking fluids were prepared from the following base formulations with the amines disclosed in tables 5–12.

| Semi-synthetic concentrate formulation | % | Synthetic concentrate formulation | % |
|---|---|---|---|
| Refined paraffinic oil | 14.2–38.2 | Triethanolamine | 47.4 |
| Anionic surfactant | 7.0 | KOH (50%) | 6.4 |
| Naphthenic acid | 5.5 | Sebacic acid | 16.5 |
| Non-ionic surfactant | 10.0 | Water | 9.7–25.7 |

-continued

| Semi-synthetic concentrate formulation | % | Synthetic concentrate formulation | % |
|---|---|---|---|
| Synthetic hydrocarbon | 17.0 | Amine | 4.0–20.0 |
| Tall oil amide | 8.0 | | |
| Water | 6.0 | | |
| KOH (50%) | 2.3 | | |
| Tridecanol, branched | 2.0–20.0 | | |
| Amine in accordance with table 5–12 | 4.0–20 | | |

The amines were added in amounts of 4, 10 and 20% to provide 1000, 2500 and 5000 ppm amine when diluted with water to a fluid concentration of 2.5%. In order to obtain homogeneous compositions tridecanol may be added in larger amounts than the minimum amounts in the table above. The increased amounts added are balanced by corresponding reductions in the amount of the mineral oil. The diluted fluids were subsequently tested with respect to their bactericidal and fungicidal effects by adding standardised bacterial and fungal inocula which were originally isolated from contaminated metalworking fluids. The inocula used in the tests were prepared as described below.

Standardised Inoculum Preparation (i) Bacteria 100 ml mineral salts media containing 2% trisodium citrate as sole carbon source (pH 9.0) in Erhlenmyer flasks were inoculated with 1 ml of a culture of Pseudomonas aeruginosa at an optical cell density of 2.0 measured at 650 nm (Perkin-Elmer UV-Vis Spectrophotometer, model Lambda 2). These inocula were incubated at 30° C. in an orbital incubator rotating at 200 rpm. During exponential growth (18 hour culture), further media were sub-inoculated in the same way, and the remaining culture harvested for testing of the diluted formulations. This subculturing procedure was continued until the end of the test period.

The cultures were harvested by centrifugation at 4000 rpm for 20 minutes (MSE Mistral 2000). The resulting bacterial pellet was resuspended in sterile Hanks saline buffer solution and recentrifuged. Three such washes were performed. Prior to the final wash, the optical density was adjusted to 2.0 (650 nm) and the volume of suspension noted. After the third wash the bacterial cells were resuspended in Hanks saline buffer to one tenth of the original volume to provide a concentrated inoculum containing approximately $1\times10^{10}$ cells $ml^{-1}$. This suspension was used as inoculum in the tests.

(ii) Fungi 100 ml mineral salts media containing 2% glucose as sole carbon source were introduced into Erhlenmyer flasks and inoculated with 1 ml of a homogenised culture of Cephalosporium sp. The inocula were incubated at 30° C. in an orbital incubator rotating at 200 rpm. After 24 hours the fungus was homogenised and subcultured as already described into glucose supplemented mineral salts media. The remaining culture was centrifuged at 4000 rpm for 20 minutes. After decanting the spent growth medium, the fungal pellet was resuspended in Hanks saline buffer and recentrifuged. After 3 washes, the final fungal pellet was resuspended in one tenth of the original volume of buffer used to provide a concentrated inoculum. This material was used as inoculum in the testing of the diluted formulations.

Test method 2.5 ml of the formulations were diluted with 97.5 ml of sterile mineral salts media introduced in 250 ml Erhlenmyer flasks. These dilutions were adjusted to pH 9.5 by adding HCl or KOH. 200 microliters of the standardised inocula were then added, either daily for the full experimental period providing a multiple inoculation, or singly, at the start of the test with an inoculum consisting of a cell density equivalent to the cumulative multiple inoculum. In this way, the investigation compared (i) the efficacy of the said amines following repeated additions where fresh supplementary biomass was introduced over a period to simulate a continuous contamination situation (i.e multiple inoculum test) and (ii) the efficacy of the said amines where a single presentation of biomass is performed and the long term effects on growth or survival can be monitored independently from the addition of fresh biomass (i.e single inoculation test). Total biomass levels in both tests were comparable.

Both fluid types were inoculated separately with the bacterial and fungal biomass to avoid possible inhibitory interactions. The semi-synthetic fluids were tested over an experimental period of 28 days, whereas satisfactory differentiation of amine performance could be achieved after 14 days in the synthetic fluids. All fluids were incubated throughout the test at 30° C. in an orbital incubator rotating at 200 rpm.

The survival of inocula, both in the multiple and single tests were monitored daily. Fungi were monitored using conventional plate counting following growth on malt extract agar (plus chloramphenicol) after serial dilution. Bacteria were enumerated directly using the rapid automated bacterial impedance technique (RABIT).

The following results were obtained.

TABLE 5

R—CH(OH)$CH_2NHC_2H_4OH$.
Efficacy against Cephalosporium.

| | | | Amine, ppm | | | |
|---|---|---|---|---|---|---|
| | | | 0 | 1000 | 2500 | 5000 |
| R | Inoculation | Formulation | Mean $\log_{10}$ cfu/ml | | | |
| $C_4H_9$ | single | semi-synth | 3.72 | 1.47 | 1.40 | 0.83 |
| $C_6H_{13}$ | single | semi-synth | 3.72 | 3.55 | 0.77 | 0.19 |
| $C_8H_{17}$ | single | semi-synth | 3.72 | 2.02 | 0 | 0 |
| $C_{10}H_{21}$ | single | semi-synth | 4.09 | 0.59 | 0 | 0 |
| $C_4H_9$ | multiple | semi-synth | 4.37 | 4.05 | 3.25 | 3.19 |
| $C_6H_{13}$ | multiple | semi-synth | 4.39 | 4.08 | 3.51 | 0.22 |
| $C_8H_{17}$ | multiple | semi-synth | 4.39 | 3.79 | 1.94 | 0 |
| $C_{10}H_{21}$ | multiple | semi-synth | 4.09 | 3.11 | 2.61 | 0.50 |
| $C_4H_9$ | single | synthetic | 3.46 | 0.94 | 0.72 | 0.69 |
| $C_6H_{13}$ | single | synthetic | 3.46 | 0.93 | 0.43 | 0 |
| $C_8H_{17}$ | single | synthetic | 3.46 | 0 | 0 | 0 |
| $C_{10}H_{21}$ | single | synthetic | 3.96 | 0 | 0 | 0 |
| $C_4H_9$ | multiple | synthetic | 4.74 | 3.60 | 3.33 | 2.96 |
| $C_6H_{13}$ | multiple | synthetic | 4.74 | 2.20 | 1.37 | 0 |
| $C_8H_{17}$ | multiple | synthetic | 4.74 | 0 | 0 | 0 |
| $C_{10}H_{21}$ | multiple | synthetic | 4.39 | 4.08 | 3.51 | 0.22 |

TABLE 6

R—$O(CH_2)_3NHC_2H_4OH$.
Efficacy against Cephalosporium.

| | | | Amine, ppm | | | |
|---|---|---|---|---|---|---|
| | | | 0 | 1000 | 2500 | 5000 |
| R | Inoculation | Formulation | Mean $\log_{10}$ cfu/ml | | | |
| $C_4H_9$ | single | semi-synth | 3.72 | 3.51 | 0.80 | 0.40 |
| $C_6H_{13}$ | single | semi-synth | 3.28 | 0.25 | 0.14 | 0 |
| $C_8H_{17}$ | single | semi-synth | 3.72 | 0.89 | 0.19 | 0 |

TABLE 6-continued

R—O($CH_2$)$_3$NH$C_2H_4$OH.
Efficacy against Cephalosporium.

| R | Inoculation | Formulation | Amine, ppm 0 | 1000 | 2500 | 5000 |
|---|---|---|---|---|---|---|
| | | | Mean $\log_{10}$ cfu/ml | | | |
| $C_{10}H_{21}$ | single | semi-synth | 3.35 | 3.82 | 0.26 | 0 |
| $C_4H_9$ | multiple | semi-synth | 4.39 | 4.02 | 3.05 | 2.57 |
| $C_6H_{13}$ | multiple | semi-synth | 3.85 | 3.86 | 2.84 | 0.12 |
| $C_8H_{17}$ | multiple | semi-synth | 4.39 | 2.95 | 0 | 0 |
| $C_{10}H_{21}$ | multiple | semi-synth | 4.29 | 4.02 | 0.83 | 0 |
| $C_4H_9$ | single | synthetic | 3.46 | 0 | 0 | 0 |
| $C_6H_{13}$ | single | synthetic | 2.87 | 0 | 0 | 0 |
| $C_8H_{17}$ | single | synthetic | 3.46 | 0 | 0 | 0 |
| $C_{10}H_{21}$ | single | synthetic | 3.21 | 0 | 0 | 0 |
| $C_4H_9$ | multiple | synthetic | 4.74 | 3.16 | 2.07 | 1.72 |
| $C_6H_{13}$ | multiple | synthetic | 3.87 | 0.30 | 0 | 0 |
| $C_8H_{17}$ | multiple | synthetic | 4.74 | 0 | 0 | 0 |
| $C_{10}H_{21}$ | multiple | synthetic | 4.67 | 0 | 0 | 0 |

TABLE 7

R—O$CH_2$CH(OH)$CH_2$—NH$C_2H_4$OH.
Efficacy against Cephalosporium.

| R | Inoculation | Formulation | Amine, ppm 0 | 1000 | 2500 | 5000 |
|---|---|---|---|---|---|---|
| | | | Mean $\log_{10}$ cfu/ml | | | |
| $C_4H_9$ | single | semi-synth | 3.72 | 3.23 | 2.46 | 3.38 |
| $C_6H_{13}$ | single | semi-synth | 3.28 | 1.52 | 0.19 | 0.14 |
| $C_8H_{17}$ | single | semi-synth | 3.72 | 2.41 | 0.79 | 0.11 |
| $C_{10}H_{21}$ | single | semi-synth | 3.35 | 2.18 | 0.45 | 0 |
| $C_4H_9$ | multiple | semi-synth | 4.39 | 4.08 | 4.09 | 4.08 |
| $C_6H_{13}$ | multiple | semi-synth | 3.85 | 4.01 | 3.77 | 2.92 |
| $C_8H_{17}$ | multiple | semi-synth | 4.39 | 3.69 | 3.31 | 0.17 |
| $C_{10}H_{21}$ | multiple | semi-synth | 4.29 | 4.33 | 3.82 | 1.78 |
| $C_4H_9$ | single | synthetic | 3.45 | 0 | 0 | 0 |
| $C_6H_{13}$ | single | synthetic | 2.87 | 0 | 0 | 0 |
| $C_8H_{17}$ | single | synthetic | 3.46 | 0.24 | 0 | 0 |
| $C_{10}H_{21}$ | single | synthetic | 3.21 | 0 | 0 | 0 |
| $C_4H_9$ | multiple | synthetic | 3.96 | 0 | 0 | 0 |
| $C_6H_{13}$ | multiple | synthetic | 3.87 | 1.06 | 1.23 | 0.61 |
| $C_8H_{17}$ | multiple | synthetic | 4.74 | 0 | 0 | 0 |
| $C_{10}H_{21}$ | multiple | synthetic | 4.67 | 0 | 0 | 0 |

TABLE 8

R—NH—$CH_2$CH(OH)$CH_2$OH.
Efficacy against Cephalosporium.

| R | Inoculation | Formulation | Amine, ppm 0 | 1000 | 2500 | 5000 |
|---|---|---|---|---|---|---|
| | | | Mean $\log_{10}$ cfu/ml | | | |
| $C_4H_9$ | single | semi-synth | 3.28 | 1.48 | 1.16 | 0.52 |
| $C_6H_{13}$ | single | semi-synth | 3.28 | 0.55 | 0.17 | 0 |
| $C_8H_{17}$ | single | semi-synth | 4.76 | 4.62 | 0.095 | 0 |
| $C_{10}H_{21}$ | single | semi-synth | 3.35 | 4.13 | 0.32 | 0.32 |
| $C_4H_9$ | multiple | semi-synth | 3.85 | 4.38 | 4.31 | 4.14 |
| $C_6H_{13}$ | multiple | semi-synth | 3.85 | 4.10 | 3.78 | 2.50 |
| $C_8H_{17}$ | multiple | semi-synth | 5.02 | 4.62 | 0.40 | 0 |
| $C_{10}H_{21}$ | multiple | semi-synth | 4.29 | 4.06 | 1.84 | 0 |
| $C_4H_9$ | single | synthetic | 2.87 | 2.50 | 1.43 | 0 |
| $C_6H_{13}$ | single | synthetic | 2.87 | 0.43 | 0 | 0 |
| $C_8H_{17}$ | single | synthetic | 4.25 | 0 | 0 | 0 |
| $C_{10}H_{21}$ | single | synthetic | 3.21 | 0 | 0 | 0 |

TABLE 8-continued

R—NH—$CH_2$CH(OH)$CH_2$OH.
Efficacy against Cephalosporium.

| R | Inoculation | Formulation | Amine, ppm 0 | 1000 | 2500 | 5000 |
|---|---|---|---|---|---|---|
| | | | Mean $\log_{10}$ cfu/ml | | | |
| $C_4H_9$ | multiple | synthetic | 3.87 | 3.52 | 3.10 | 2.70 |
| $C_6H_{13}$ | multiple | synthetic | 3.87 | 2.69 | 1.92 | 0.85 |
| $C_8H_{17}$ | multiple | synthetic | 3.78 | 1.38 | 0.37 | 0 |
| $C_{10}H_{21}$ | multiple | synthetic | 4.67 | 0 | 0 | 0 |

TABLE 9

R—CH(OH)$CH_2$—NH$CH_2CH_2$OH.
Efficacy against *Pseudomonas aeruginosa.*

| R | Inoculation | Formulation | Amine, ppm 0 | 1000 | 2500 | 5000 |
|---|---|---|---|---|---|---|
| | | | Mean $\log_{10}$ cfu/ml | | | |
| $C_4H_9$ | single | semi-synth | 9.43 | 8.41 | 0.56 | 0 |
| $C_6H_{13}$ | single | semi-synth | 9.43 | 7.38 | 0.85 | 0.18 |
| $C_8H_{17}$ | single | semi-synth | 9.43 | 7.73 | 8.13 | 6.81 |
| $C_{10}H_{21}$ | single | semi-synth | 8.22 | 8.24 | 6.14 | 6.04 |
| $C_4H_9$ | multiple | semi-synth | 9.32 | 7.52 | 4.24 | 2.10 |
| $C_6H_{13}$ | multiple | semi-synth | 9.32 | 6.88 | 4.69 | 0.82 |
| $C_8H_{17}$ | multiple | semi-synth | 9.32 | 8.21 | 7.53 | 5.49 |
| $C_{10}H_{21}$ | multiple | semi-synth | 8.70 | 8.10 | 7.21 | 7.19 |
| $C_4H_9$ | single | synthetic | 8.25 | 6.32 | 0.75 | 0.73 |
| $C_6H_{13}$ | single | synthetic | 8.25 | 6.42 | 0 | 0 |
| $C_8H_{17}$ | single | synthetic | 8.25 | 4.58 | 0 | 0 |
| $C_{10}H_{21}$ | single | synthetic | 8.59 | 7.71 | 3.79 | 7.10 |
| $C_4H_9$ | multiple | synthetic | 7.73 | 5.99 | 4.03 | 3.75 |
| $C_6H_{13}$ | multiple | synthetic | 7.73 | 5.65 | 0 | 0 |
| $C_8H_{17}$ | multiple | synthetic | 7.73 | 3.39 | 0 | 0 |
| $C_{10}H_{21}$ | multiple | synthetic | 7.94 | 7.38 | 7.14 | 5.60 |

TABLE 10

R—O($CH_2$)$_3$—NH$CH_2CH_2$OH.
Efficacy against *Pseudomonas aeruginosa.*

| R | Inoculation | Formulation | Amine, ppm 0 | 1000 | 2500 | 5000 |
|---|---|---|---|---|---|---|
| | | | Mean $\log_{10}$ cfu/ml | | | |
| $C_4H_9$ | single | semi-synth | 9.43 | 8.30 | 0.53 | 0 |
| $C_6H_{13}$ | single | semi-synth | 8.29 | 7.74 | 4.95 | 0 |
| $C_8H_{17}$ | single | semi-synth | 9.43 | 7.54 | 7.21 | 0 |
| $C_{10}H_{21}$ | single | semi-synth | 8.55 | 7.27 | 7.15 | 5.83 |
| $C_4H_9$ | multiple | semi-synth | 9.32 | 7.55 | 4.63 | 0.92 |
| $C_6H_{13}$ | multiple | semi-synth | 8.71 | 7.82 | 4.00 | 0 |
| $C_8H_{17}$ | multiple | semi-synth | 9.32 | 7.32 | 7.28 | 0 |
| $C_{10}H_{21}$ | multiple | semi-synth | 9.69 | 6.68 | 7.19 | 6.12 |
| $C_4H_9$ | single | synthetic | 8.25 | 6.09 | 0.45 | 0 |
| $C_6H_{13}$ | single | synthetic | 8.63 | 0 | 0 | 0 |
| $C_8H_{17}$ | single | synthetic | 8.25 | 0 | 0 | 0 |
| $C_{10}H_{21}$ | single | synthetic | 6.98 | 0.80 | 0 | 0 |
| $C_4H_9$ | multiple | synthetic | 7.73 | 5.49 | 1.16 | 0 |
| $C_6H_{13}$ | multiple | synthetic | 8.46 | 2.46 | 0 | 0 |
| $C_8H_{17}$ | multiple | synthetic | 7.73 | 0 | 0 | 0 |
| $C_{10}H_{21}$ | multiple | synthetic | 7.53 | 3.18 | 0 | 0 |

TABLE 11

R—$OCH_2CH(OH)CH_2$—$NHCH_2CH_2OH$.
Efficacy against *Pseudomonas aeruginosa*.

| | | | Amine, ppm | | | |
|---|---|---|---|---|---|---|
| | | | 0 | 1000 | 2500 | 5000 |
| R | Inoculation | Formulation | Mean $\log_{10}$ cfu/ml | | | |
| $C_4H_9$ | single | semi-synth | 9.43 | 8.47 | 8.08 | 7.57 |
| $C_6H_{13}$ | single | semi-synth | 8.29 | 7.89 | 7.67 | 0 |
| $C_8H_{17}$ | single | semi-synth | 9.43 | 8.15 | 7.50 | 7.10 |
| $C_{10}H_{21}$ | single | semi-synth | 8.55 | 8.07 | 8.96 | 7.78 |
| $C_4H_9$ | multiple | semi-synth | 9.32 | 8.68 | 7.06 | 7.50 |
| $C_6H_{13}$ | multiple | semi-synth | 8.71 | 8.23 | 6.90 | 3.48 |
| $C_8H_{17}$ | multiple | semi-synth | 9.32 | 7.79 | 7.40 | 5.96 |
| $C_{10}H_{21}$ | multiple | semi-synth | 9.69 | 6.94 | 8.39 | 7.21 |
| $C_4H_9$ | single | synthetic | 8.59 | 6.76 | 0 | 0 |
| $C_6H_{13}$ | single | synthetic | 8.63 | 6.59 | 0 | 0 |
| $C_8H_{17}$ | single | synthetic | 8.25 | 6.01 | 5.74 | 1.48 |
| $C_{10}H_{21}$ | single | synthetic | 6.98 | 6.18 | 5.74 | 5.71 |
| $C_4H_9$ | multiple | synthetic | 7.94 | 4.87 | 3.55 | 0 |
| $C_6H_{13}$ | multiple | synthetic | 8.46 | 7.49 | 6.62 | 0 |
| $C_8H_{17}$ | multiple | synthetic | 7.73 | 6.39 | 4.09 | 0 |
| $C_{10}H_{21}$ | multiple | synthetic | 7.53 | 6.53 | 6.50 | 6.33 |

TABLE 12

R—$NHCH_2CH(OH)CH_2OH$.
Efficacy against *Pseudomonas aeruginosa*.

| | | | Amine, ppm | | | |
|---|---|---|---|---|---|---|
| | | | 0 | 1000 | 2500 | 5000 |
| R | Inoculation | Formulation | Mean $\log_{10}$ cfu/ml | | | |
| $C_4H_9$ | single | semi-synth | 8.29 | 8.34 | 8.09 | 7.78 |
| $C_6H_{13}$ | single | semi-synth | 8.29 | 7.99 | 7.24 | 0 |
| $C_8H_{17}$ | single | semi-synth | 9.16 | 6.75 | 4.18 | 2.80 |
| $C_{10}H_{21}$ | single | semi-synth | 8.55 | 7.96 | 7.45 | 4.49 |
| $C_4H_9$ | multiple | semi-synth | 8.71 | 8.30 | 6.83 | 7.85 |
| $C_6H_{13}$ | multiple | semi-synth | 8.71 | 8.90 | 7.63 | 3.26 |
| $C_8H_{17}$ | multiple | semi-synth | 8.42 | 6.91 | 6.82 | 1.27 |
| $C_{10}H_{21}$ | multiple | semi-synth | 9.69 | 7.80 | 7.35 | 4.84 |
| $C_4H_9$ | single | synthetic | 8.63 | 7.72 | 7.52 | 0.24 |
| $C_6H_{13}$ | single | synthetic | 8.63 | 0 | 0 | 0 |
| $C_8H_{17}$ | single | synthetic | 7.74 | 2.49 | 0 | 0 |
| $C_{10}H_{21}$ | single | synthetic | 6.98 | 0 | 0 | 0 |
| $C_4H_9$ | multiple | synthetic | 8.46 | 8.06 | 7.47 | 7.55 |
| $C_6H_{13}$ | multiple | synthetic | 8.46 | 8.15 | 2.96 | 0 |
| $C_8H_{17}$ | multiple | synthetic | 7.62 | 0 | 0 | 0 |
| $C_{10}H_{21}$ | multiple | synthetic | 7.53 | 0 | 0 | 0 |

It is evident that the secondary amines of the invention have excellent antimicrobial effects. Especially good results are shown by the alkanolamines of formula III in the semisynthetic formulations, while all alkanolamines of the formulae II, III, IV and V exhibit excellent results in the synthetic formulations.

What is claimed is:

1. A process for providing a composition with a corrosion inhibiting and antimicrobial agent, comprising:

incorporating into the composition an effective amount of a corrosion inhibiting and antimicrobial agent comprised of a secondary amine having a formula:

$$R(Y)_sNHX \quad (I),$$

wherein:

R is an hydrocarbon group having 2–12 carbon atoms,

Y is a group selected from the group consisting of —$CH(OH)CH_2$—, —$OCH_2CH(OH)CH_2$—, and —$O(CH_2)_3$—, X is an alkyl group having 2–3 carbon atoms and being substituted by hydroxyl groups in one of the 2-position or the 2- and 3-positions, and s is 0 or 1 provided that when s is 0, then X is one of an alkyl group substituted in the 2- and 3-positions or a salt thereof.

2. The process in accordance with claim 1, wherein R is an alkyl group having 4–10 carbon atoms.

3. The process in accordance with claim 1, wherein the composition is an aqueous, alkaline industrial fluid.

4.The process in accordance with claim 3, wherein the aqueous, alkaline industrial fluid is selected from the group consisting of a metal working fluid, a hydraulic fluid, a coolant, a heat transfer medium, and a cleaning fluid.

5. The process in accordance with claim 1, wherein the secondary amine is present in the composition in an amount ranging from 0.001 to 10% by weight.

6. The process in accordance with claim 5, wherein the secondary amine is present in the composition in an amount ranging from 0.01 to 2% by weight.

7. The process in accordance with claim 1, wherein the composition is a synthetic formulation, and wherein the corrosion inhibiting and antimicrobial agent is employed for an antimicrobial effect.

8. An aqueous alkaline metal working fluid which has a pH value of at least 8, comprising:

from 0.001 to 10% by weight of a secondary amine having a formula:

$$R(Y)_sNHX \quad (I),$$

wherein;

R is an hydrocarbon group having 2–12 carbon atoms,

Y is a group selected from the group consisting of —$CH(OH)CH_2$—, —$OCH_2CH(OH)CH_2$—, and —$O(CH_2)_3$—, X is an alkyl group having 2–3 carbon atoms and being substituted with hydroxyl groups in one of the 2-position or the 2- and 3-positions, and s is 0 or 1 provided that when s is 0, then X is one of an alkyl group substituted in the 2- and 3-positions or a salt thereof.

9. The aqueous alkaline metal working fluid in accordance with claim 8, wherein the secondary amine is present in an amount ranging from 0.01 to 2% by weight.

10. The aqueous alkaline metal working fluid in accordance with claim 8, wherein R is an alkyl group having 4–10 carbon atoms.

11. The aqueous alkaline metal working fluid in accordance with claim 8, wherein the secondary amine has the formula $RO(CH_2)_3NHC_2H_4OH$.

12. The aqueous alkaline metal working fluid in accordance with claim 8, wherein the secondary amine has the formula $RO(CH_2)_3NHC_2H_4OH$, and wherein R is an alkyl group having 4–10 carbon atoms.

13. A solution containing the aqueous alkaline metal working fluid in accordance with claim 18, wherein s in the formula of the secondary amine is 1.

* * * * *